United States Patent [19]

Smith, Jr.

[11] 4,050,378

[45] * Sept. 27, 1977

[54] METERED SPRAY DAMPENING SYSTEM

[75] Inventor: Roy R. Smith, Jr., Leawood, Kans.

[73] Assignee: Smith R.P.M. Corporation, Lenexa, Kans.

[ * ] Notice: The portion of the term of this patent subsequent to Apr. 13, 1993, has been disclaimed.

[21] Appl. No.: 618,962

[22] Filed: Oct. 2, 1975

Related U.S. Application Data

[63] Continuation-in-part of Ser. No. 515,688, Oct. 17, 1974, Pat. No. 3,949,668.

[51] Int. Cl.[2] ..... B41F 7/30; B41L 25/06

[52] U.S. Cl. ..... 101/147; 101/366; 118/313

[58] Field of Search ..... 101/147, 148, 366, 364; 118/302, 312, 313; 239/124, 125, 127; 417/283, 296, 297, 298, 301, 305, 395, 205, 199 A

[56] References Cited

U.S. PATENT DOCUMENTS

| | | | |
|---|---|---|---|
| 1,185,667 | 6/1916 | Hoe | 101/366 X |
| 1,185,668 | 6/1916 | Hoe | 101/366 X |
| 1,924,731 | 8/1933 | Barnes | 101/366 |
| 2,389,730 | 11/1945 | Iger | 101/147 |
| 2,714,853 | 8/1955 | Schlamann | 417/205 |
| 3,023,968 | 3/1962 | Mitchell | 239/125 |
| 3,065,693 | 11/1962 | Neal et al. | 101/366 |
| 3,341,124 | 9/1967 | Barnes | 239/124 X |
| 3,348,774 | 10/1967 | Wiggins | 118/302 X |
| 3,450,092 | 6/1969 | Kock | 118/302 X |
| 3,529,626 | 9/1970 | German | 239/124 X |
| 3,651,756 | 3/1972 | Smith, Jr. | 101/147 |
| 3,949,668 | 4/1976 | Smith, Jr. | 101/148 |

FOREIGN PATENT DOCUMENTS

| | | | |
|---|---|---|---|
| 692,103 | 8/1964 | Canada | 417/305 |

*Primary Examiner*—J. Reed Fisher
*Attorney, Agent, or Firm*—Fishburn, Gold & Litman

[57] ABSTRACT

A multiple spray nozzle, offset press dampening system of the type having individual metering pumps for the respective nozzles utilizes a device for opening the pump output valves while maintaining dampening liquid feed pressure substantially elevated, thereby purging feed lines, pump passageways and pump chambers of bubbles and particles which would interfere with accurate metering. Constant recirculation and filtering of the feed liquid under pressure maintains purging liquid substantially bubble and particle free.

7 Claims, 6 Drawing Figures

METERED SPRAY DAMPENING SYSTEM

This is a Continuation-in-Part of copending application Ser. No. 515,688, now U.S. Pat. No. 3,949,668, filed Oct. 17, 1974.

This invention relates to dampening apparatus for offset printing presses of the type utilizing individual metering pumps for a plurality of spray nozzles, and more particularly, to improvements in the liquid feed system therefor.

The concept of multiple spray nozzle dampening systems wherein individual metering pumps are provided for respective nozzles was disclosed in U.S. Pat. No. 3,651,756, issued Mar. 28, 1972, and constituted a significant advance in the lithographic dampening art in that it permitted fine control for optimum dampening under highly varied conditions of press speed, paper and ink requirements. The apparatus disclosed therein has been highly satisfactory for a substantial range of printing requirements, however, control was occasionally found to be inadequate for producing extremely high quality printing, as on fine, coated papers. It has now been determined that at least a portion of the control inadequacy has been caused by the formation of tiny bubbles which collected within the metering pumps during and between printing runs and slightly interfered with the accuracy of pump discharge. Also, particles of solid matter in the liquid are believed to occasionally interfere with pump valves, further contributing to unwanted pump output variations.

The gross bubble problem was previously recognized and, as described in said U.S. Pat. No. 3,651,756, system priming structure was provided to eliminate bubbles contained in the pump output chambers where they tended to congregate. However, the use of such a priming device presented certain difficulties, for example, during a very high quality printing run it would tend to vary moisture delivery to an extent which is unacceptable. Also, bubbles or particles upstream from the pump output chambers would be unaffected by the priming and potentially troublesome shortly thereafter. The improvement described herein involves a two-part approach to avoid said difficulties by (1) utilizing a substantial increase in moisture feed pressure upstream from and within the metering pump, thereby substantially inhibiting any tendency for bubble formation or entry in the metering pumps, along with providing a device for selectively opening the pump output valves while maintaining said increased pressure, thereby purging feed lines, pump passageways and pump chambers of bubbles and particles within and adjacent the pumps. The improvement still further preferably utilizes constant circulation or recirculation of the feed liquid from the vicinity of the pump inputs to the liquid source through a filter medium to further reduce the chances of contamination by physical, chemical or biological agents.

The principal objects of the present invention are: to provide a dampening apparatus and method for offset printing presses which permit extremely fine and dependable moisture flow control suitable for the highest quality printing; to provide such apparatus which is relatively inexpensive to manufacture and easily adapted to the printing press; to provide such an apparatus and method which substantially reduces or eliminates metering pump output variations caused by bubbles or foreign particles within pump chambers; to provide such apparatus which may be easily added to both new and existing multi-pump, offset press dampening systems; and to provide such apparatus which is highly reliable and requires a minimum amount of attention for operation and maintenance.

Other objects and advantages of this invention will become apparent from the following description taken in connection with the accompanying drawings wherein are set forth, by way of illustration and example, certain embodiments of this invention.

Figure 1:
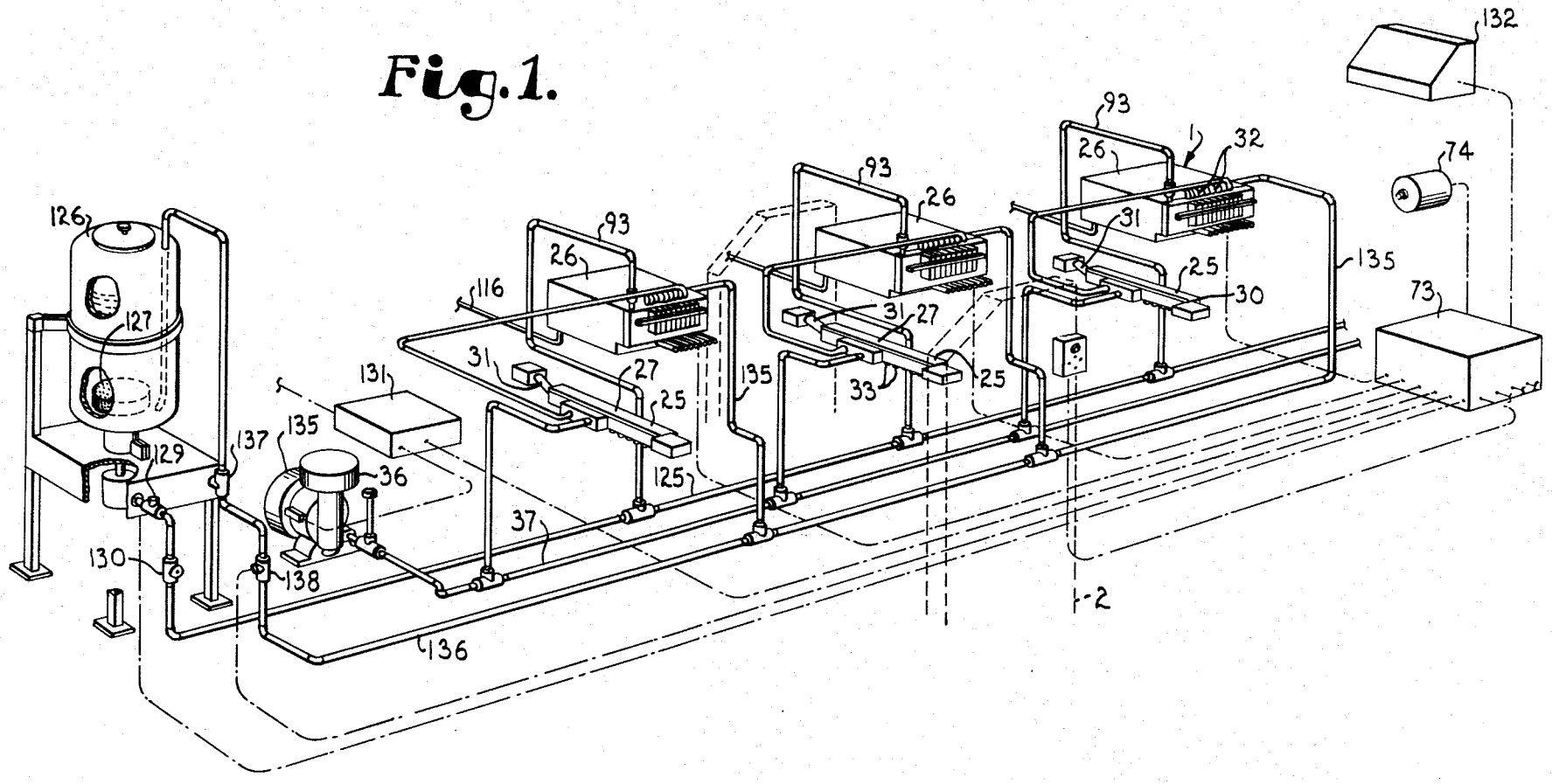
FIG. 1 is a partially schematic, perspective view showing a spray dampening system embodying this invention, spray apparatus for three printing towers being illustrated.

Referring to the drawings in more detail:

The reference numeral 1 generally indicates an example of improved dampening apparatus embodying this invention. The apparatus 1 is illustrated for use on a rotary, offset, web printing press 2 (FIG. 2) of a conventional type having an ink transfer train 3 including an ink fountain 4, hard rollers 5–9 and relatively soft (e.g., rubber) rollers 10–17. By means of the ink transfer train 3, ink 18 in the fountain 4 is transferred and evenly distributed to a lithographic printing plate 19 on a plate roller 20. The ink 18 adheres to the plate 19 only at predetermined locations, and the ink image thereby formed is transferred to a blanket cylinder 21. The image is deposited from the cylinder 21 upon a moving paper web 22 which is maintained in plate contact by means of an impression cylinder 23. The rollers and cylinders above noted are driven directly or indirectly through typical press drive means (not shown) which synchronize the described printing operation with additional printing towers and various known operating devices in a well-known manner.

Referring to this invention, the apparatus 1 includes a spray bar or member 25 mounted on respective towers of the press 2 adjacent the ink transfer train 3 and a pump assembly or member 26 mounted in spaced relation to the spray member 25 but connected thereto with multiple, liquid carrying hoses are described below.

Figure 2:
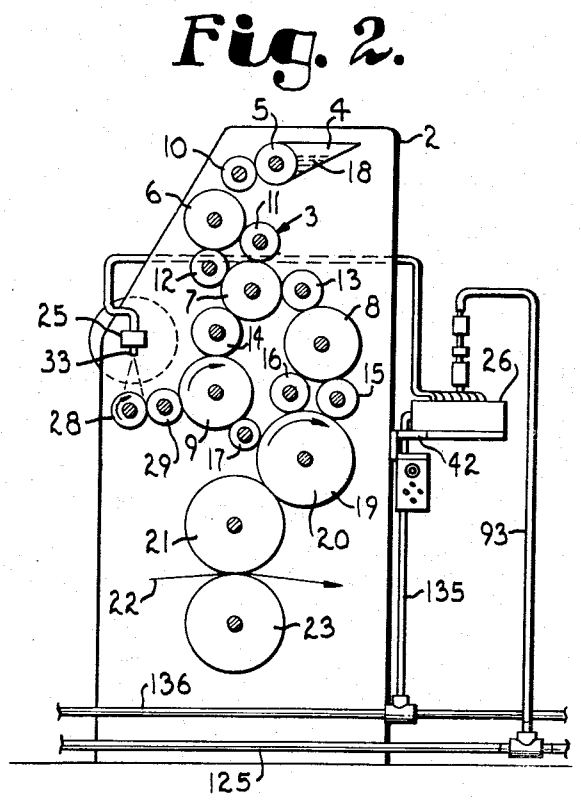
FIG. 2 is a partially schematic, fragmentary, side elevation showing the system in conjunction with a typical printing tower.

The spray member 25 has an elongated body portion 27 mounted on the press 2 longitudinally adjacent selected dampener rollers 28 and 29 (FIG. 2). The body portion 27 is suitably secured at opposite ends 30 thereof by means of swinging support arms 31 suitably pivotally anchored to the frame of the printing tower.

Figure 5:
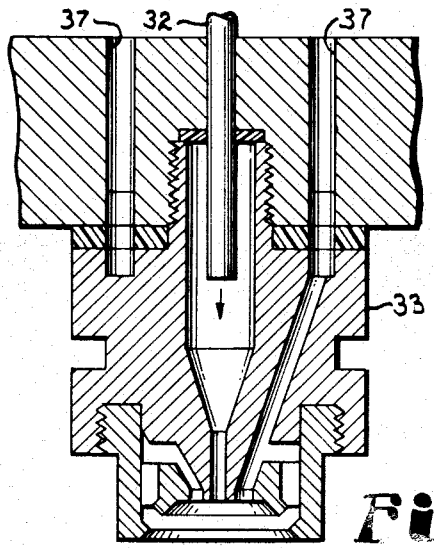
FIG. 5 is a fragmentary, cross-sectional view, on a substantially enlarged scale over FIG. 1, illustrating a typical spray nozzle.

The spray members 25 contain conduits or passageways (not shown) directing individual hoses 32 to respective spray nozzles 33 (FIG. 5) which are secured in laterally spaced relation on the body portion 27 (FIG. 1). In this example, the spray nozzles 33 are directed generally toward the nip formed between the dampener rollers 28 and 29, however, it is to be understood that substantial variations in the spray disposition arrangement may be utilized, depending upon many variable factors and press designs, so long as the spray 34 remains operatively directed to travel toward the plate cylinder 19 (FIG. 2).

The spray nozzles 33 are characterized as having unvalved liquid exit openings, as is more clearly described in said U.S. Pat. No. 3,651,756. In this example, a blower 35 (FIG. 1) draws air through a cleaning filter 36 and directs it, under pressure, within a suitable duct system 37 to the spray members 25 for cooperation with metering pumps, described below, to produce a flow of atomized liquid out of the respective spray nozzles 33.

Figure 3:
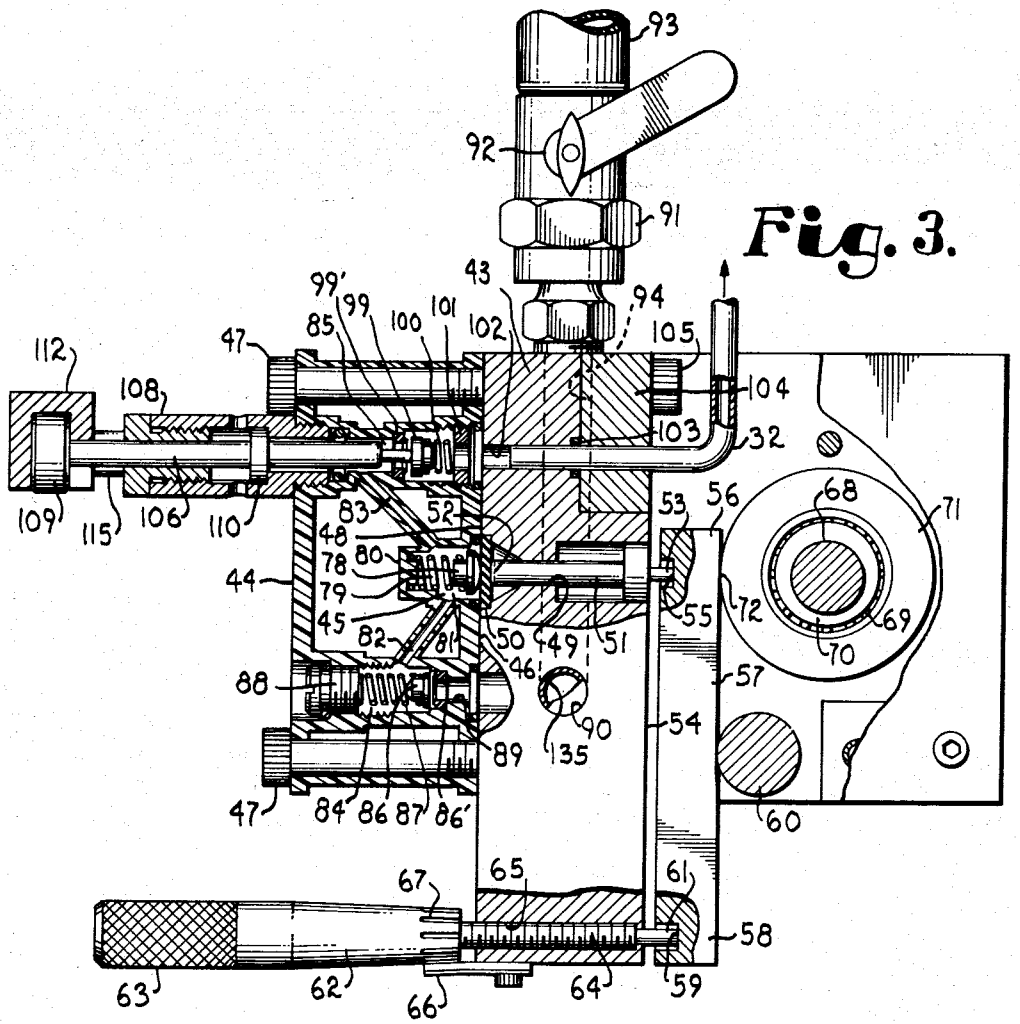
FIG. 3 is a fragmentary side elevation, on a substantially enlarged scale over FIG. 1, with portions broken away, illustrating the internal structure of a metering pump incorporating valve opening structure of this invention.

The pump member 26 comprises a frame 41 mounted, in this example, by means of a bracket 42 to a convenient location on the frame of the tower in the vicinity of the spray member 25. The frame 41 includes a manifold block or portion 43 (FIG. 3) into which the individual spray nozzle hoses 32 communicate as described further below. A separate pump valve retainer or block 44 is provided for each of the nozzles 33 and includes a pump recess 45 extending thereinto from an exterior surface 46, the recess 45 here being formed by a depression cast in a synthetic resin framework. The blocks 44 are mounted by suitable screws 47 onto the manifold portion 43 with the recess 45 pressed against an exterior surface 48 of the manifold portion 43. A plurality of bores 49 extend in laterally spaced relation through the manifold portion 43 and are respectively axially aligned with the pump recesses 45. Flexible diaphragm seals or pump means 50 are positioned between the respective recess 45 and the bores 49, effectively isolating them from each other.

Plungers 51 are reciprocally received in the respective manifold portion bores 49 and exhibit a forward end 52 bearing against one side of the respective diaphragm seal 50. The bores 59 form a guide passageway for the plungers 51 and expand near the surface 48, producing a seat for supporting the edges of the diaphragm seals 50.

The plungers 51 include diametrically reduced projections 53 extending axially opposite to the ends 52 and beyond the exterior surface 54 of the manifold portion 43. The projections 53 are received into sockets 55 located in drive ends 56 of respective rocker arms 57. The rocker arms 57 each have an adjusting end 58, opposite from the drive end 56, and containing a socket 59 opening laterally in the same direction as the socket 55. A fulcrum rod 60 is suitably anchored with respect to the frame 41 and extends along the manifold portion 43, engaging the rocker arms 57 at points intermediate the ends 56 and 58.

The sockets 59 receive the tips 61 of adjusting members 62, each having a handle 63 and a threaded extension 64 received in a threaded bore 65 extending through the manifold portion 43. The tips 61 bear against the rocker arm adjusting end 58, thereby adjustably limiting the length of the reciprocal stroke which can be taken by the respective plungers 51. A suitable detent 66 is resiliently urged against the handle 63 and is selectively received in circumferentially spaced notches 67 for maintaining the adjusting member in a desired rotary position, but permitting easy readjustment by manual rotation of the handle.

A drive shaft 68 is rotatably mounted on the pump member 26 and extends along the respective rocker arms 57. A plurality of bearings 69 have eccentric inner races 70 and are spaced along the drive shaft 68, aligned respectively with the arms 57. Cylindrical spacers 71 fit over the bearings 69 and are effectively positioned adjacent the back side 72 of the rocker arm drive ends 56. The races 70 are eccentric with the axis of the drive shaft 68, for example, one thirty-second of an inch, whereby, upon proper adjustment, the rotation of the shaft reciprocally drives the plunger 51 through the rocker arm drive ends 56, although the spacers 71 may remain rotationally stationary. A suitable variable speed motor (not shown) is preferably mounted within the pump member 26 and in driving engagement with the shaft 68. The motor effects rotation of the shaft 68 at a desired speed suitably associated with the speed of the printing press by appropriate control circuits contained, for example, in an enclosure 73, receiving speed information from a tachometer signal generator 74 rotated by the press drive (not shown).

In the valve block 44, a pin 78 is located in the pump recess 45 and bears against the front surface of the diaphragm seal 50. The body of the pin 78 is received axially within a helical compression spring 79 which urges the pin against the seal by bearing against a wall support 80. The wall support 80 and diaphragm seal 50 are spaced apart and sealed with respect to the pump recess 45, forming a pump chamber 81 therebetween.

Lower and upper passageways 82 and 83, in this example formed by tubes integral with the balance of the valve block 44, communicate into the pump chamber 81 and also, respectively, into an intake valve chamber 84 and an output valve chamber 85 formed in the respective lower and upper portions of the valve block 44. The intake valve chamber 84 has a valve seal or plug 86, here shown open but normally resiliently seated or loaded against a seal ring 86' by means of a helical spring 87 compressed thereagainst with a threaded seal plug 88. The intake valve chamber 84 communicates through a pump input portion, or bore 89, with a manifold passageway 90 (FIGS. 3 and 5) formed in the manifold portion 43. The manifold passageway 90 is branched along its length, thereby communicating with each bore 89 in the respective valve blocks 44. The manifold passageway 90 is fed dampening liquid through a suitable plumbing fitting 91 incorporating a manual shut-off valve 92 and communicating with a feed hose 93 described further below. The fitting 91 communicates with the manifold passageway 90 through a passageway 94 (FIG. 3) in the manifold block or portion 43.

The output valve chamber 85 has a valve seal or plug 99, here shown open but normally resiliently seated or loaded against a seal ring 99' by means of a helical spring 100 bearing thereagainst through pressure exerted by a threaded plug 101 having a central passageway therethrough. The passageway in the plug 101 provides communication between the valve chamber 85 and respective passageway 102 in the manifold portion 43. The passageways 102 receive input ends of the respective hoses 32, sealing therewith through suitable "O" rings 103 maintained in sealing engagement through pressure exerted by a block 104 secured to the manifold portion 43 by screws 105.

Figure 6:
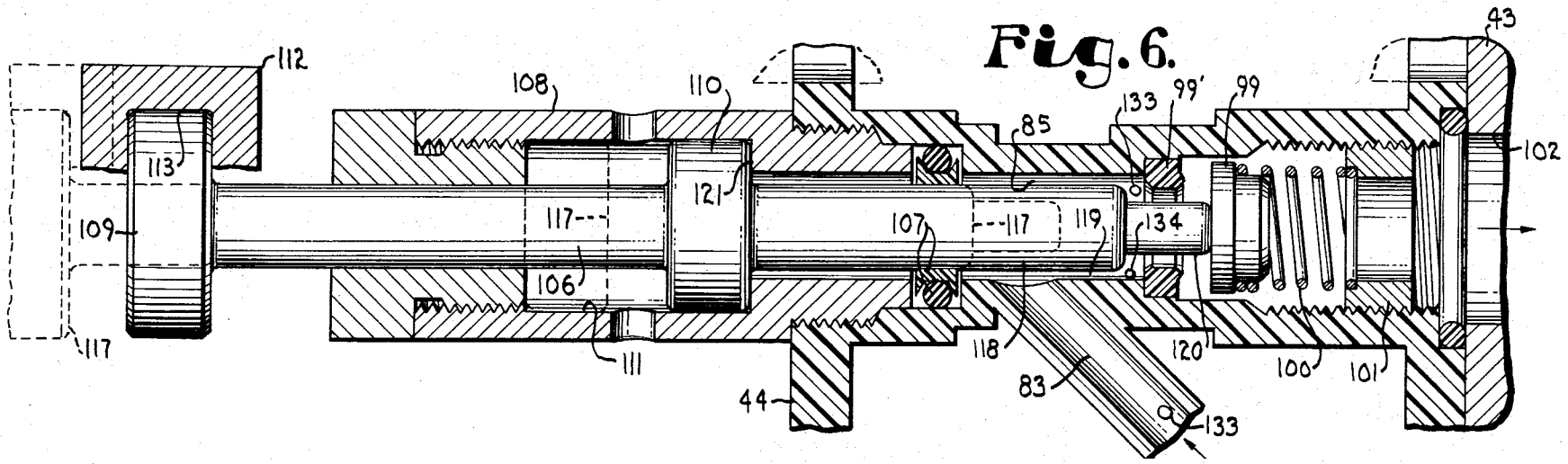
FIG. 6 is a fragmentary, cross-sectional view on a substantially enlarged scale over FIG. 3, showing said valve opening structure in the valve-open position.

The output valve chambers 85 each have a rod 106 received partially thereinto and slidably sealed through suitable seal members 107. The rod 106 is movably supported in a barrel 108 threadedly retained in the block 44 and projects rearwardly of said barrel, terminating in an external knob 109. An expanded skirt portion 110 is slidably received in a chamber 111 formed in the barrel 108 and cooperates therewith to guide the rod 106 coaxially of the output valve chamber 85. A transverse bar 112 contains a downwardly open slot 113 receiving the respective knobs 109 therein and the heads 114 of air cylinders 115 to move the pistons 109 simultaneously mounted at opposite ends of the manifold portion 43. The air cylinders 115 are actuated through a compressed air line 116 (FIG. 1) to simultaneously move the rods 106 on demand reciprocally between the limited positions illustrated by the full lines and broken line 117 (FIG. 6).

The forward portion 118 of the rod 106, which extends into the output valve chamber 85, has a diameter significantly smaller than said chamber 85, providing a free passageway 119 between the upper passageway 83 and the seal ring 99' (FIG. 7). The rod 106 further exhibits a nipple 120 projecting forwardly from the forward portion 118 and, when the rod 106 is in the forward position illustrated by the full lines in FIG. 6, through seal ring 99'. The nipple 120 is of smaller diameter than the inside diameter of the seal ring 99', permitting a continuation of the free passageway 119 therethrough regardless of rod position in the valve chamber 85. When the rod 106 is fully forward, as determined, in this example, by contact between the skirt portion 110 and chamber wall 121, the nipple 120 contacts and urges the valve plug 99 away from the seal ring 99', thereby opening the passageway 119 to the discharge hose 32. Thus, by operation of the air cylinders 115, the loaded output valves of the metering pumps may be held open for an extended period independently of pump function.

The feed hoses 93 extend from the fitting 91 and communicate with a main dampener liquid supply hose 125 which is fed, in this example, from a supply tank 126 through a filter 127, pressure pump 128, check valve 129 and pressure regulator 130. The pump 128 is actuated, together with the blower 35 and the printing press drive, by suitable press switches and controls 131 and 132 and functions to raise the pressure in the hoses 125 and 93 to a predetermined amount above atmospheric. The check valve 129 prevents reverse flow, thus maintaining the pressure in the closed liquid feed system, even during periods when the pump 128 is temporarily not actuated. The regulator 130 is utilized to adjustably control pressure downstream therefrom to a desired predetermined amount, however, it is to be understood that a separate regulator may be unnecessary if the output from the pump 128 is otherwise maintained (regulated) at the desired pressure.

The spring 87 in the intake valve chamber 84 is relatively low in compressive force, bearing on the valve plug 86 lightly, but sufficiently to create a seal in absence of an overcoming forward differential pressure. In contrast, the spring 100 bearing against the output valve disc 99, is relatively strong whereby a relatively high pressure is required within the pump for liquid flow to occur past the valve plug 99 and into the hose 32.

The pressure in the supply hose 125 and feed hoses 93 is controlled by the regulator 130 to an amount which is easily sufficient to compress the spring 87 and drive liquid past the intake valve plug 86 but insufficient to compress the spring 100 and drive liquid also past the output valve plug 99. Thus, elevated pressure is constantly maintained in the system from the supply hose 125 through the feed hoses 93, internal passageways and chambers of the valve block 44 to the inner face of the output valve plug 99. The reciprocation of the respective plungers 51, through rotation of the drive shaft 68, produces added pressure within the pump arrangement, compressing the spring 100 and thereby opening the output valve plug 99 upon each pump stroke and producing accurately metered liquid flow out of the respective hose 32. However, pressure, even on the suction stroke does not fall below a predetermined elevated amount above atmospheric within the pump due to the liquid feed pressure.

Thus bubbles 133, which may tend to form from dissolved gas in the liquid due to liquid turbulence, temperature changes, chemical reactions and/or pressure drops, will be suppressed, due to the elevated pressure, until the liquid is past the output valve plug 99 where they will be harmlessly discharged through the nozzles 33 without interference with the metered liquid discharge of the pump.

The bar 112 and cylinders 115 may be utilized, as desired, to open the output valve plugs 99, thereby allowing the pressure in the supply base 125 to urge the intake valve plug 86 open and flush out any existing bubbles 133 or particulate matter 134 within not only the entire flow passageways and all the chambers of the pump, but also within the manifold passageway 90 and adjacent parts of the feed base 93. Such a flushing is especially indicated when the press has not been operated for an extended period of time and pressure may have bled down in the liquid supply network. The use of the bar 112 is also sometimes desirable to supply the relatively heavy moisture demands immediately on start-up, however, such flushing will normally be unnecessary and undesirable during the press run.

Figure 4:
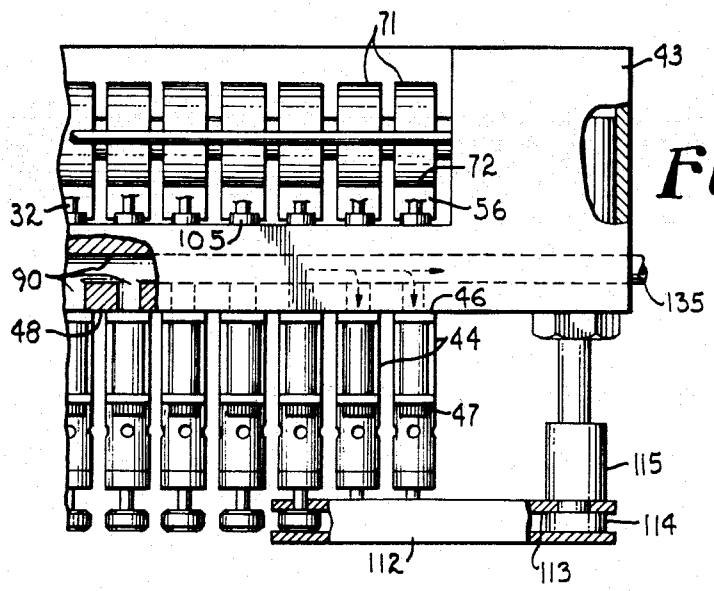
FIG. 4 is a fragmentary plan view showing a bank of metering pumps and partially illustrating the flow path for fluid recirculation.

Referring to FIG. 4, the manifold passageway 90 is connected to an outlet hose 135 which joins a return hose 136 whereby the unused or excess portion of the dampening liquid is recirculated back to the supply tank 126. A suitable hose or line restriction 137 is placed in the return hose 136 so that the desired pressure may be retained in the system while recirculation of excess liquid is obtained. A solonoid check valve 138 is also placed in the return hose 136 to block flow completely when the press is deactuated, thereby producing cooperation with the check valve 129 for maintaining bubble inhibiting pressure in the liquid feed system. With this flow arrangement the excess liquid moving through the dampener feed system is constantly agitated, recirculated and redirected through the filter 127, thereby further reducing the possibility of bubble formation, the introduction of solid particles into the pumps, growth of biological materials such as fungi, etc., which may interfere with proper system operation.

Although particular pressure within the system may be varied, it has been found that a suitable operational arrangement utilizes a metering pump intake valve requiring one to two psig to open, a metering pump output valve requiring approximately 10 psig to open and a liquid pressure regulator set to maintain, in cooperation with the source feed pump, approximately 5 to 6 psig in the liquid supply network.

It is to be understood that, although certain forms of this invention have been illustrated and described, it is not to be limited thereto except insofar as such limitations are included in the following claims.

What is claimed and desired to secure by Letters Patent is:

1. For use in combination with an offset printing press, a lithographic dampener system, said dampener system comprising:

a. a spray member having a plurality of dampening liquid atomizing spray nozzles, individual dampening liquid output conduit means connected at one end thereof to said nozzles, b. a pump member having a plurality of individual, bubble and particle sensitive, reciprocal metering pumps respectively including an input portion containing a loaded input valve and an output portion containing a loaded output valve which periodically opens as a result of metering pump operation, said output valve being loaded to a substantially greater opening pressure than said input valve and a pump pathway extending between said input and output valves, c. said output conduit means being respectively individually connected at the other end thereof to one of said metering pump output portions whereby each spray nozzle is connected to a separate metering pump, said metering pumps respectively having reciprocating pump means communicating with said pump pathways between said input and output valves and alternately increasing and decreasing the dampening liquid volume of the respective pump pathway, d. a source of dampening liquid susceptible to bubble formation and particle inclusion therein, input conduit means connected between said liquid source and said respective input portions, a feed pump operably located in said input conduit means, e. pressure regulator means associated with said feed pump and together controlling the feed pressure of said dampening liquid into said respective input portions to a point above atmospheric pressure an amount sufficient to suppress the formation of bubbles and greater than that required to open said loaded input valve but less than the sum of the opening pressures of said input plus output valve, thereby causing said dampening liquid to be maintained substantially above atmospheric pressure during flow from said feed pump and through said metering pumps, whereby bubbles tending to form in said dampening liquid are urged to remain in solution permitting accurate metering by said respective metering pumps, and f. means selectively maintaining said loaded output valves simultaneously in an open position independently of pump function and without blocking said output portions, whereby bubbles and particulate matter in said dampening liquid are driven by said feed pressure through said pump pathways and past said output valves.

2. The dampener system as set forth in claim 1 including:

a. a return passageway connected between said metering pumps and said source and directing excess dampening liquid back to said source, said return passageway forming with said source and input conduit means a recirculation system for excess dampening liquid, and b. a filter in said recirculation system and aiding in maintaining said dampening liquid clean and bubble free.

3. The dampener system as set forth in claim 2 including:

a. a restriction in said return passageway and aiding in the prevention of excess pressure drop upstream therefrom.

4. The dampener system as set forth in claim 1 wherein:

a. a check valve is operably positioned downstream from said feed pump and upstream from said respective input portions, b. said check valve inhibiting pressure drop between said check valve and said respective output valves.

5. The dampener system as set forth in claim 1 wherein:

a. said input valves are loaded to an opening pressure of approximately one to two psig, b. said output valves are loaded to an opening pressure of approximately ten psig, and c. said feed pump and regulator means maintain said feed pressure at approximately five to six psig.

6. The dampener system as set forth in claim 1 wherein:

a. said means selectively maintaining said output valve open comprises a member reciprocally mounted in said metering pumps and positioned for selectively physically contacting said output valve.

7. The dampener system as set forth in claim 6 wherein:

a. said reciprocally mounted member is a rod axially movable in said pump output portion and having a diameter less than said output portion permitting liquid flow axially thereof.

* * * * *